United States Patent [19]

Eberlein et al.

[11] Patent Number: 4,608,790

[45] Date of Patent: Sep. 2, 1986

[54] TRUSSING, PARTICULARLY THREE-DIMENSIONAL TRUSSING, MADE OF ELONGATED MEMBERS AND JOINT ELEMENTS

[75] Inventors: Helmut Eberlein, Würzburg; Otto Kornberger, Hettstadt, both of Fed. Rep. of Germany

[73] Assignee: MERO-Raumstruktur GmbH & Co., Würzburg, Fed. Rep. of Germany

[21] Appl. No.: 560,841

[22] Filed: Dec. 13, 1983

[30] Foreign Application Priority Data

Dec. 14, 1982 [DE] Fed. Rep. of Germany ..... 3246203

[51] Int. Cl.[4] ..... E04B 1/32

[52] U.S. Cl. ..... 52/81; 52/648; 52/468; 52/469; 160/399

[58] Field of Search ..... 52/81, 648, 652, 637, 52/662, 469, 459, 460, 468, 465; 160/391, 393, 399; 403/174, 178, 23

[56] References Cited

U.S. PATENT DOCUMENTS 3,909,994 10/1975 Richter ..... 52/81 X
3,916,589 11/1975 Richter ..... 52/81
4,297,825 11/1981 Harper, Jr. ..... 52/81 X

FOREIGN PATENT DOCUMENTS 608899 5/1978 U.S.S.R. ..... 52/81

*Primary Examiner*—Carl D. Friedman
*Assistant Examiner*—Naoko N. Slack
*Attorney, Agent, or Firm*—Quaintance, Murphy & Presta

[57] ABSTRACT

To avoid a flimsy arrangement of a roof or outside covering composed of individual plate elements on three-dimensional trussing, and also to produce a solid roof or outside covering, holding spaces are provided on the tops of elongated members of the three-dimensional trussing. The spaces have a smooth cup-shaped cross section, into which the outside edges of plate elements are inserted with their parts which are also in cup-shaped cross section, which serves to hold packing strips. First, plate elements are connected with the elongated members by cover rails with downwardly angled arms, which are fastened by screws to each member, and then packing strips are pressed into the cup-shaped outside edges of plate elements, so that plate elements are attached to members of the three-dimensional trussing with packing, which forms a tight roof or outside covering.

6 Claims, 6 Drawing Figures

TRUSSING, PARTICULARLY THREE-DIMENSIONAL TRUSSING, MADE OF ELONGATED MEMBERS AND JOINT ELEMENTS

BACKGROUND OF THE INVENTION

The invention relates to trussing, particularly to three-dimensional trussing, made of elongated or rod members and joints, which supports plate elements, e.g., roofing elements, wherein the members have holding spaces running parallel to their axes for the packed connection of the outside edges of the plate elements.

Such a packed connection of the outside edges of plate elements to the members of a three-dimensional trussing has already been disclosed in German PS No. 1 928 840. In this construction, the holding spaces for the relatively thick outside edges of the plate elements to be connected are found on opposite sides of rectangular members and are limited at the top and bottom by strips screwed onto the members. The packing material is U-shaped and surrounds the outside edge of a plate lying opposite a member. This packing arrangement however is unreliable, if changes arise in the three-dimensional trussing.

A structure for the production of a covering for three-dimensional trussing composed of individual plate-shaped roof elements is already known from German Gm No. 8 123 976. The packing occurs on either side of the plate-shaped roof elements in this embodiment in that the roof elements include cups, near their top edges, of which the top edges run parallel, in which are found packing strips, which in turn are pressed by a cover rail with arms angled downwardly. These cover rails thus bridge over the gap between adjacent plate edges and are held tight by screws, which extend between the cover rails and holding rails on the bottom of the roof elements. The covering which is thus constructed of the individual plate-shaped roof elements is supported by special support plates by means of stationary threaded bolts on the joints of the three-dimensional trussing. This solution, however, is not efficient, because of the propped-up arrangement of the covering.

SUMMARY OF THE INVENTION

Objects of the present invention are embodied in the following features:

(a) the holding spaces are on the tops of the elongated members and have smooth cup-shaped cross sections, (b) the outside edges of the plate elements are angled downwardly and inwardly and have a cup-shaped cross section to receive a packing strip, (c) the outside edges of the plate elements on both sides of each elongated member have their cup-shaped cross sections in the holding spaces on the member, (d) a cover rail is provided with downwardly angled arms to fit in the cup-shaped outside edges of any two adjacent plate elements, (e) the arms of the cover rail are pressed against the packing strips by fastening means, such as screws, inserted in the member, whereupon the outside edges of the plate elements are fastened onto the elongated member.

This packed connection of the outside edges of the plate elements directly to the members of the trussing or three-dimensional trussing is economical and also works efficiently, even when, e.g., thermally-caused expansions or similar changes occur on the trussing or three-dimensional trussing. The assembly of the plate-shaped elements, e.g., roof elements, is simple for the construction of a covering, since special holder structures are not needed for the covering.

The advantages of the aforementioned known constructions still remain and, accordingly, the cover rails and packing strips join flush on the adjoining top of the plate-shaped elements. The plate-shaped elements can be simple sheet metal or also sandwich construction, wherein at least the outside layer is a sheet metal material, which projects over the other layers with its cup-shaped cross section part. Another essential advantage of the invention resides in that in case a leak should still occur, water trickling through from the front packed holding space is held in the holding space and cannot, as in the present state of the art, trickle through between the plate element and the elongated member.

In one embodiment of the invention, the fastening of the cover rails onto the members is simplified since the crosspiece intended to receive the fastening screws also serves as a bearing for the cover rails. Also, the fastening screws can slide longitudinally in the hollow crosspiece, whereupon the assembly is further simplified.

Advantageously, the present invention can be used with elongated members of very different profiles.

BRIEF DESCRIPTION OF THE DRAWINGS

The invention is explained relative to the drawings of exemplary embodiments as follows.

DESCRIPTION OF THE PREFERRED EMBODIMENTS

Figure 1:
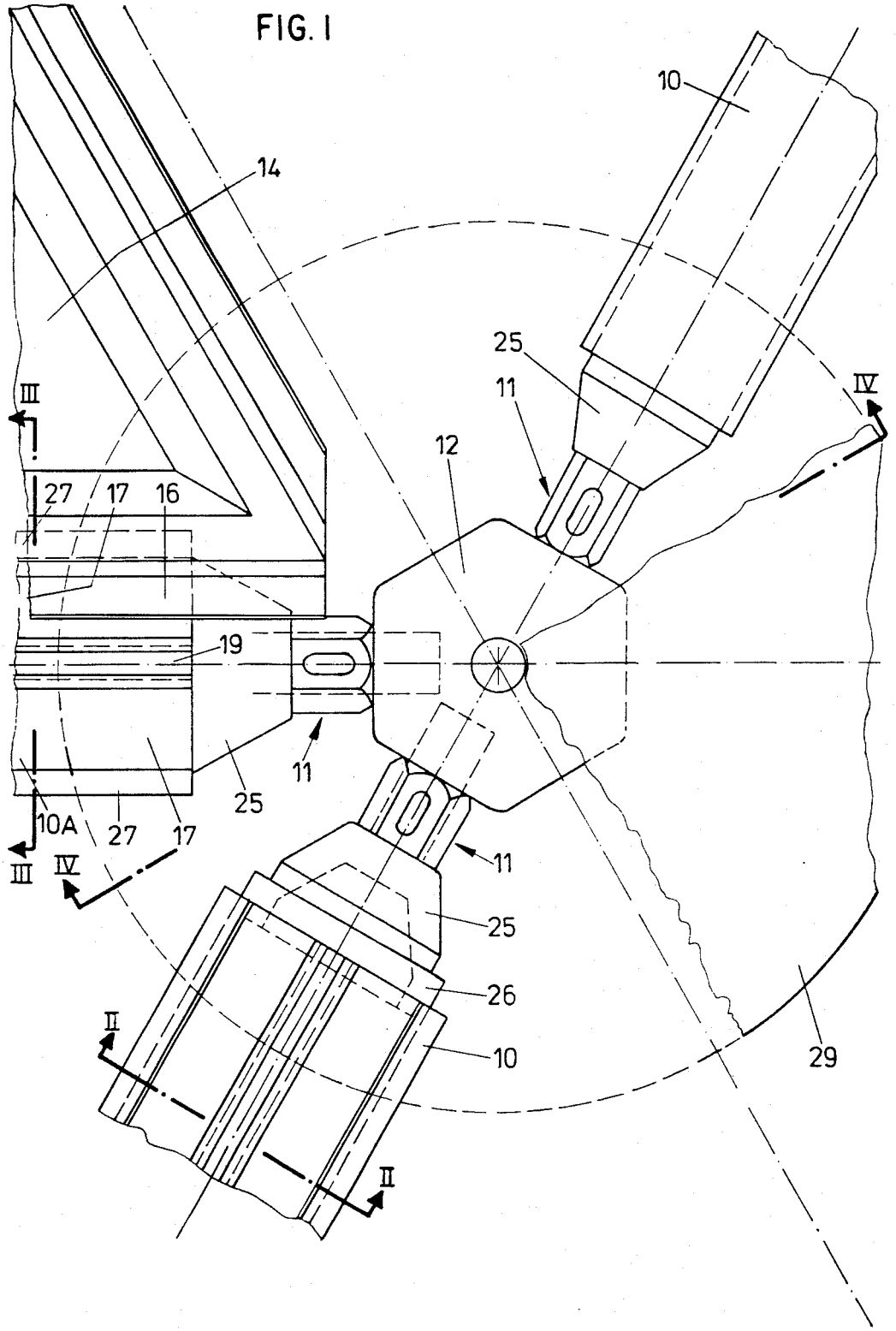
FIG. 1 is a top plan view, with parts broken away, of a domed three-dimensional trussing in the area of a joint element with a part of a roof element of triangular cross section.

In FIGS. 1–6, 10 and 10A are the elongated or rod members of a domed three-dimensional trussing, which are connected with joint elements 12 by screw connections 11. The domed three-dimensional trussing supports a covering 13, which is composed of individual plate-shaped roof elements 14 with different rectangular cross sections (see FIG. 5). The roof elements 14 are of sheet metal, but, as shown in broken lines in FIG. 2, they can also be formed of sheet metal or the like with a foam layer 15 or the like adhering thereto for heat insulation. The latter embodiment can be lined on the inside by another piece of sheet metal or plastic. If, as in the present case, the domed three-dimensional trussing is provided to cover large containers, a covering of simple sheet metal or of light metal will suffice.

Roof elements 14 are provided with inwardly and downwardly angled, cup-shaped outside edges 16, which hold packing strips 9. The individual roof elements 14 are fastened directly to the tops of members 10 of the three-dimensional trussing. Members 10 could have the rectangular hollow profile shown in cross section in FIG. 2 or could have the tubular profile of 10A of FIG. 3. The profiles of the members are indicated only as illustrative examples in FIGS. 1 and 3. It is to be understood that in practice all of the members of one three-dimensional trussing element will have substantially the same profile.

Members 10 or 10A, independent of the cross section profile of their top portions in the embodiment shown, are each provided with two holding spaces 17 running parallel to their axes, for the cup-shaped outside edges 16 of adjacent roof elements 14. Holding spaces 17 are separated by a crosspiece 18 in the middle, running down the middle, which has a lengthwise slot 19 which is open to the outside as well as opposite guide grooves 20. Thus, fastening screws 21 can be inserted from one of the open ends with their heads fitting in crosspiece 18 (see FIG. 3), by means of which a cover rail 23 can be tightly connected, e.g., by connecting cap nuts 22 with member 10. The length of cover rail 23 corresponds approximately to the length of the elongated member. Each cover rail 23 has arms 24, turned downwardly on their lengthwise edges, which engage in the cup-shaped outside edges 16 of the adjacent roof element 14, and when screw connections 21, 22 are tightened, roof elements 14 clamp on the top of member 10 and press packing strips 9, so that packed connections of roof elements 14 on members 10 and therewith a tight covering 13 are obtained.

Figure 2:
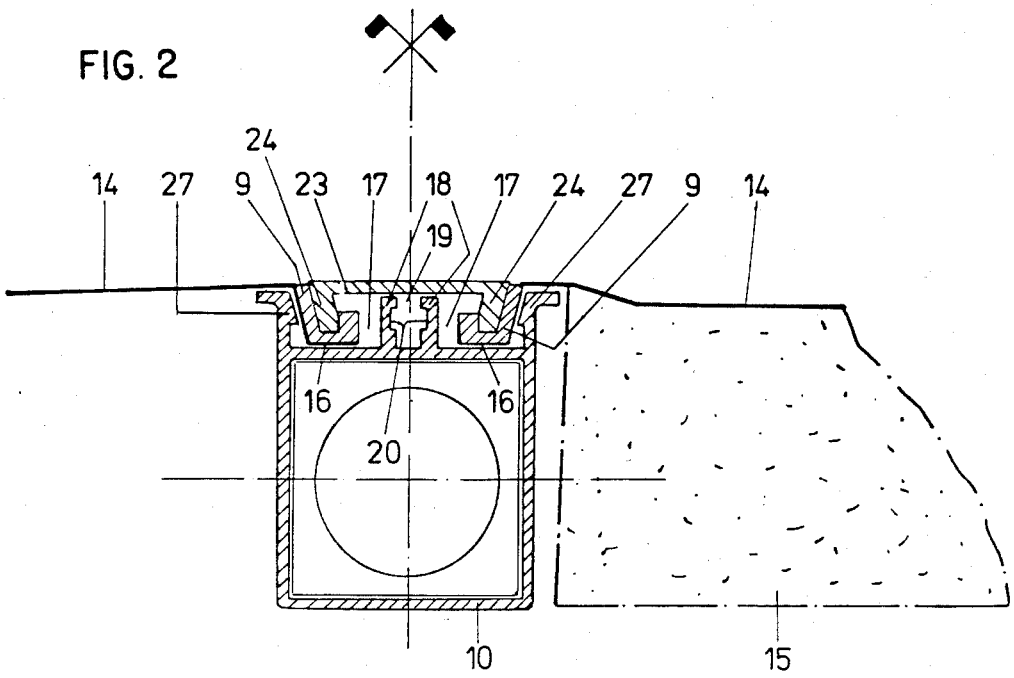
FIG. 2 is a partial cross-sectional view taken substantially along line II—II of FIG. 1.
Figure 6:
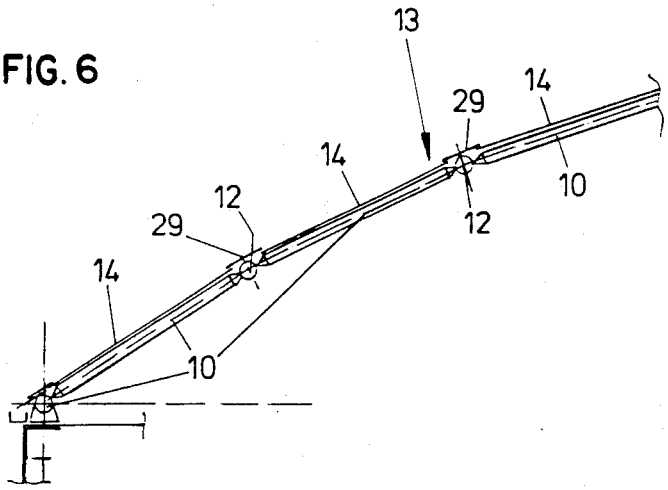
FIG. 6 is a partial side elevational view of a portion of the trussing shown in FIG. 5.

In the embodiment of FIG. 2, member 10 has a rectangular hollow profile, and it is provided on both ends with obtuse conical connection elements 25 with fitted rectangular mountings 26, which receive the screw bolts (not shown) of screw connections 11. The holding spaces 17 for the outside edges 16 of roof elements 14 extend on both sides of crosspiece 18 and are terminated on the outside by longitudinal members 27 with outwardly angled support edges.

Figure 3:
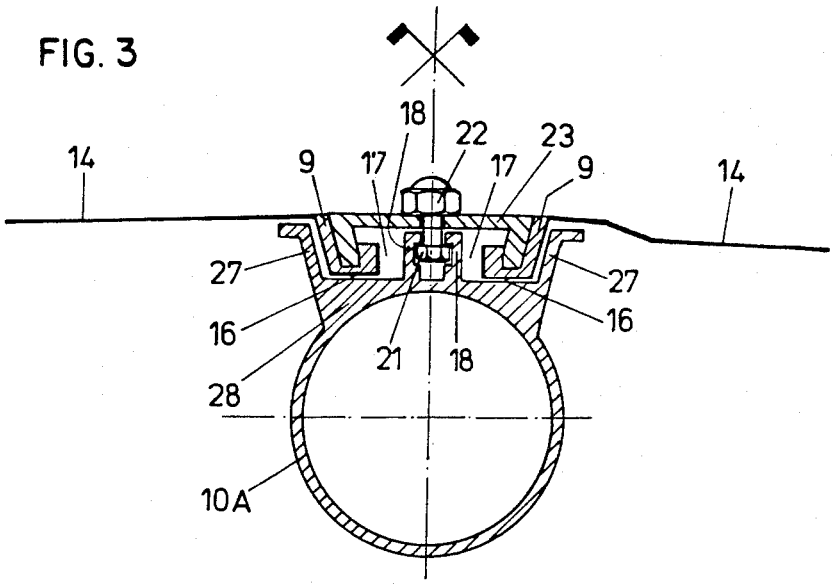
FIG. 3 is another partial cross-sectional view taken substantially along line III—III of FIG. 1, which shows a different member cross section from that of FIG. 2.

In the exemplary embodiment of FIG. 3, member 10A is of tubular cross section and has a projection 28 which is like a rail, which contains holding spaces 17, lengthwise crosspiece 18, and both outside members 27. Members 10 and 10A may be manufactured by extrusion pressing of, e.g., light metal. The obtuse conical connection element 25 is fastened in member 10A with a fitting round mounting in the ends.

Figure 5:
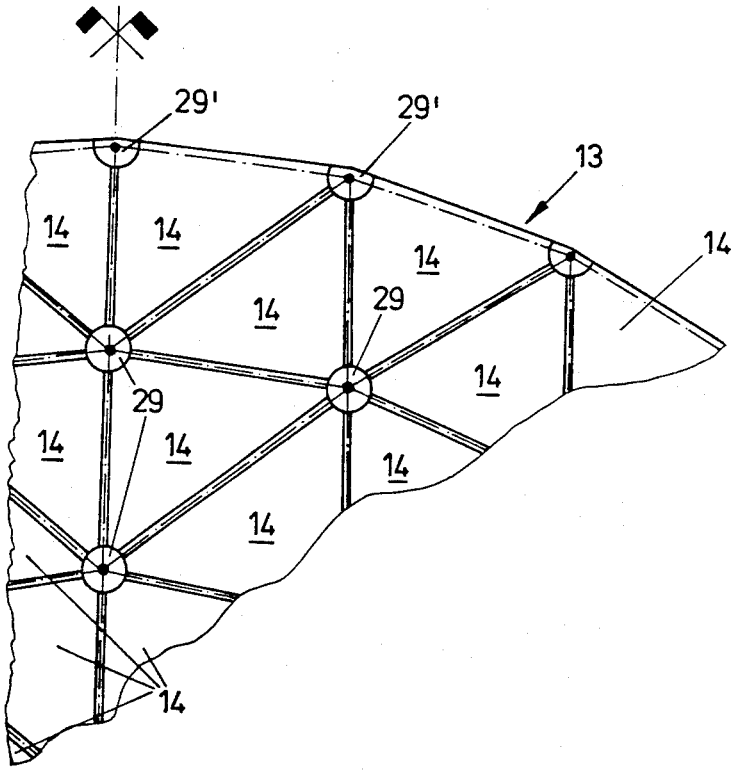
FIG. 5 is a top plan view of a part of a domed three-dimensional trussing, which can be used e.g. as the covering for a large container.
Figure 4:
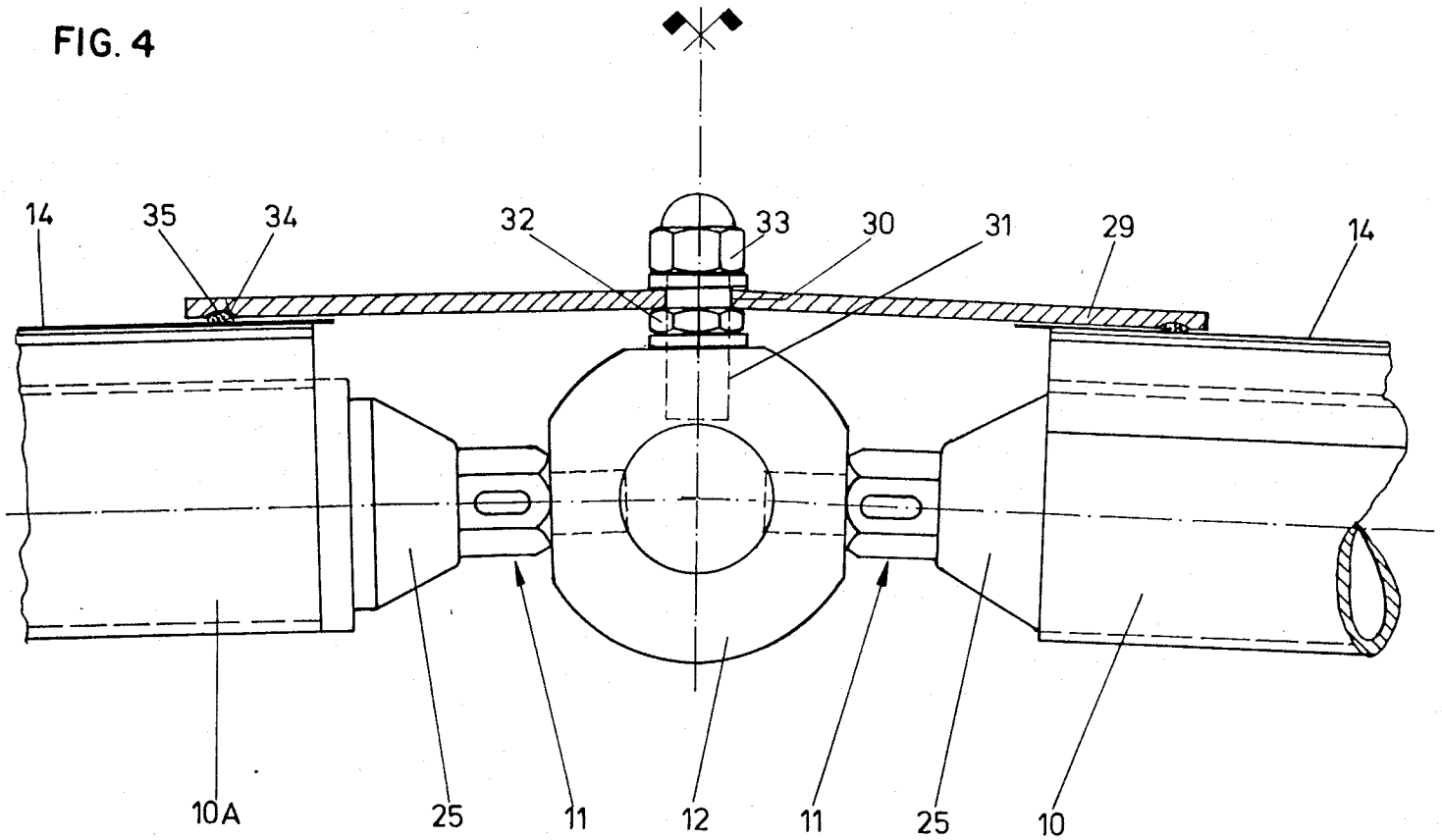
FIG. 4 is a further partial cross-sectional view taken substantially along line IV—IV of FIG. 1.

Roof elements 14 are packed on the outside around joint elements 12 by means of a circular cover plate 29, which overlaps the corners of roof elements 14 and also cover rails 23 bridging over them, as shown in FIG. 1. In FIG. 1, most of cover plate 29 is broken away and shown only by broken lines. On the outside edge of the three-dimensional trussing, as shown in FIG. 5, only the corresponding segments 29' of the cover plates are provided. Each cover plate 29 or 29' is mounted on a threaded bolt 31 by a middle bore 30, which is threaded into one of the threaded bores of joint element 12. Cover plate 29 is fastened to threaded bolt 31 by means of a nut 32 and a cap nut 33.

Each cover plate 29 has at least one annular, concentric groove 34 on the inside, into which a packing ring 35 is inserted, and is pressed against roof element 14 and cover rail 23 which are adjacent to joint element 12, during tightening of cap nut 33. The area of covering 13 on the outside over a joint element 12 is thus also packed efficiently.

As aforementioned, the roof elements 14 can be of simple sheet metal, e.g., aluminum, or even of sandwich construction, with relatively thick cross section, and such roof elements then fill the spaces between members 10 of the three-dimensional trussing. In any case, however, the roof elements preferably have cup-shaped outside edges 16 projecting over the edge, in order to facilitate the protected packing and fastening of the roof elements to members 10 or 10A by means of cover rails 23.

What we claim is:

1. Trussing, particularly three-dimensional trussing, made of elongated members and joint elements, which support plate elements, e.g., roof elements, having a top surface and outside edges, wherein the elongated members have upper portions with recessed holding spaces running substantially parallel to their longitudinal axes for a packed connection of the outside edges of the plate elements, characterized by a combination of the following elements:

(a) said holding spaces (17) have a smooth generally cup-shaped cross section, (b) said outside edges (16) of plate elements (14) are angled inwardly and downwardly from said top surface and have a generally cup-shaped cross section, (c) a packing strip (9) is disposed in each of said outside edges (16) of plate elements (14), (d) the outside edges (16) of adjacent plate elements (14) are positioned on both sides of each elongated member (10) with their cup-shaped cross section inserted into said holding spaces (17) in each elongated member (10), (e) an elongated cover rail (23) extends over each elongated member (10) and has downwardly angled arms (24) extending into the cup-shaped outside edges (16) of the adjacent plate elements, said arms (24) being in engagement with the packing strips (9) disposed in said outside edges (16), (f) fastening means (21) connects said cover rail (23) and said elongated member (10), said fastening means pressing said arms (24) against said packing strips (9), (g) said cover rail having a generally flat upper surface in substantial alignment with the top surfaces of adjacent plate elements (14), and (b) a generally flat cover plate secured to each joint element and extending over the adjacent portions of said plate elements (14), said elongated members (10) and said cover rails (23), said cover plate being in sealing engagement with the underlying adjacent portions of said plate elements (14) and said cover rails (23).

2. Trussing as in claim 1, characterized in that a crosspiece (18) is provided in the upper portion of each elongated member (10), said crosspiece (18) extending down the midportion of the elongated member (10) in substantially parallel relation to the longitudinal axis thereof to define a holding space (17) on each side thereof, said crosspiece (18) having a slot (19) therein for receiving said fastening means (21).

3. Trussing as in claim 2, characterized in that said crosspiece (18) has a lengthwise slot (19) provided with opposite guide grooves (20) to hold said fastening means (21).

4. Trussing as in claim 3 characterized in that said fastening means (21) comprises a threaded bolt (21) having its head disposed in said slot (19).

5. Trussing as in claim 1, characterized in that said elongated members (10) have generally rectangular hollow profile, and the cross-sectional width of each holding space (17) corresponds approximately to the width of one side of said elongated member (10).

6. Trussing as in claim 1, characterized in that the elongated members (10A) have generally round hollow profile, onto which is fitted a rail-like projection (28), which contains holding space (17).

* * * * *